US012202654B2

(12) United States Patent
Padilla

(10) Patent No.: US 12,202,654 B2
(45) Date of Patent: Jan. 21, 2025

(54) TRIANGULAR PACKAGES HAVING AUTOBOTTOMS AND BLANKS THEREFOR

(71) Applicant: WestRock Packaging Systems, LLC, Atlanta, GA (US)

(72) Inventor: Jesus A. Padilla, Hoschton, GA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 50 days.

(21) Appl. No.: 17/920,376

(22) PCT Filed: Apr. 20, 2021

(86) PCT No.: PCT/US2021/028060

§ 371 (c)(1),
(2) Date: Oct. 20, 2022

(87) PCT Pub. No.: WO2021/216484

PCT Pub. Date: Oct. 28, 2021

(65) Prior Publication Data

US 2023/0159212 A1 May 25, 2023

Related U.S. Application Data

(60) Provisional application No. 62/704,082, filed on Apr. 20, 2020.

(51) Int. Cl.
*B65D 5/36* (2006.01)
*B65D 5/00* (2006.01)

(52) U.S. Cl.
CPC ..... *B65D 5/3614* (2013.01); *B65D 5/008* (2013.01)

(58) Field of Classification Search
CPC ..... B65D 5/3614; B65D 5/008; B65D 5/029; B65D 5/106; B65D 5/3628; B65D 5/46096; B65D 5/3621; B65D 5/2028
USPC ..... 229/115, 108.1, 117, 117.14, 116; 206/170
See application file for complete search history.

(56) References Cited

U.S. PATENT DOCUMENTS

| | | | | |
|---|---|---|---|---|
| 648,008 A | | 4/1900 | Wellman | |
| 2,807,403 A | | 9/1957 | Joseph | |
| 3,185,378 A | | 5/1965 | Rosenburg, Jr. | |
| 3,756,497 A | * | 9/1973 | Stewart | B65D 59/04 229/148 |
| 4,269,348 A | * | 5/1981 | Young | B65D 5/10 229/117.14 |

(Continued)

FOREIGN PATENT DOCUMENTS

EP 1431196 A1 6/2004

OTHER PUBLICATIONS

International Search Report Issued in PCT/US2021/028060 issued Jul. 13, 2021.

*Primary Examiner* — Christopher R Demeree
(74) *Attorney, Agent, or Firm* — Brian J. Goldberg; Rohini K. Garg

(57) ABSTRACT

In accordance with at least one aspect of this disclosure, a package can include a three-sided body formed of three or more body panels and an autobottom connected to the three-sided body and formed of three or more bottom panels extending from a respective body panel of the plurality of the three or more body panels. The autobottom can connect all of the three or more body panels together in a triangular shape when the three or more bottom panels are interacting with each other.

19 Claims, 8 Drawing Sheets

(56) References Cited

U.S. PATENT DOCUMENTS

| | | | | | |
|---|---|---|---|---|---|
| 4,339,067 | A * | 7/1982 | Bessey | B65D 5/0209 | 229/162.5 |
| 4,428,525 | A * | 1/1984 | Brauner | B65D 5/66 | 229/148 |
| 4,607,784 | A * | 8/1986 | Calabrese | A47C 5/005 | 297/188.1 |
| 5,125,565 | A * | 6/1992 | Rogers | B44D 3/12 | 229/149 |
| 5,597,112 | A * | 1/1997 | Knapp | B65D 5/029 | 229/116 |
| 6,698,382 | B1 * | 3/2004 | Blaszak | A01K 1/0125 | 119/168 |
| 8,397,978 | B2 * | 3/2013 | Wang | B65D 5/029 | 229/115 |
| 11,230,403 | B2 * | 1/2022 | Valencia | B65D 5/46096 | |

* cited by examiner

TRIANGULAR PACKAGES HAVING AUTOBOTTOMS AND BLANKS THEREFOR

FIELD

This disclosure relates to packages, e.g., having autobottoms that form when the package is formed.

BACKGROUND

Existing packages are limited in shape complexity while still allowing autobottoms as the geometric complexity forbids simple autobottom formation as in a square package, for example.

Such conventional methods and systems have generally been considered satisfactory for their intended purpose. However, there is still a need in the art for packages having triangular autobottoms and blanks therefor. The present disclosure provides a solution for this need.

SUMMARY

In accordance with at least one aspect of this disclosure, a package can include a three-sided body formed of three or more body panels and an autobottom connected to the three-sided body and formed of three or more bottom panels extending from a respective body panel of the plurality of the three or more body panels. The autobottom can connect all of the three or more body panels together in a triangular shape when the three or more bottom panels are interacting with each other.

The autobottom can be configured to fully enclose a bottom opening of the package. The autobottom can fit entirely within the triangular shape such that no portion of the autobottom extends laterally outside of the three or more body panels when the three or more bottom panels are interacting with each other.

The three or more body panels can be sized to have a width such that the three-sided body forms an equilateral triangle for the triangular shape. The three or more body panels can include four body panels, for example. The four body panels can include a third body panel and a fourth body panel of the same size, and a first body panel and a second body panel together having a total size of the third body panel or the fourth body panel. In certain embodiments, the first body panel and the second body panel can each have a size that is half of the third body panel or the fourth panel. Any other suitable size for one or more of the panels to form any triangular three-sided body is contemplated herein.

Each body panel can be connected to each adjacent body panel at a respective fold line. Any other suitable connections are contemplated herein.

The three or more autobottom panels can include at least a first bottom panel, a second bottom panel, a third bottom panel, and a fourth bottom panel. Each bottom panel can be foldably connected to a respective body panel.

The package can include a first attachment tab foldably connected to the first bottom panel and a second attachment tab foldably connected to the second bottom panel. The first bottom panel and the second bottom panel can be foldably or breakably connected to each other or can be separated from each other.

In certain embodiments, a third attachment tab can be foldably connected to the fourth bottom panel. The first attachment tab can be attached to an underside of the fourth bottom panel and the second attachment tab can be attached to an underside of the third bottom panel. The third attachment tab can be attached to an underside of the third bottom panel.

The package can be configured to fold into a flattened position by allowing the first and second body panels to be folded inwardly while allowing the bottom panels to be folded upwardly. Each attachment tab can be configured to fold relative to a respective bottom panel to allow the bottom panels to be folded upwardly.

In accordance with at least one aspect of this disclosure, a blank can be configured to form any embodiment of a package disclosed herein (e.g., as described herein). In accordance with at least one aspect of this disclosure, a blank for a package can include three or more body panels connected by a respective body fold line between each body panel and configured to form a triangular shape, and a plurality of bottom panels, a respective bottom panel of the plurality of bottom panels foldably connected to a respective body panel of the three or more body panels, wherein the plurality of bottom panels are configured to form an autobottom that at least partially forms a bottom of the package, wherein the autobottom connects all of the three or more body panels together in a triangular shape when the three or more bottom panels are interacting with each other in an opened state.

The autobottom can be configured to fully enclose a bottom opening of the package. The three or more body panels can be the dimensioned such that the three-sided body forms an equilateral triangle for the triangular shape.

The triangular shape can be a regular triangle, for example, or any other suitable triangle. The first bottom panel can have a substantially triangular shape and can have a first attachment tab foldably connected thereto. The second bottom panel can have a substantially triangular shape and can have a second attachment tab foldably connected thereto. The third bottom panel can have a substantially symmetric trapezoidal shape or substantially triangle shape. The fourth bottom panel can have a substantially trapezoidal shape (e.g., non-isosceles). Any other suitable shapes and/or sizes are contemplated herein.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
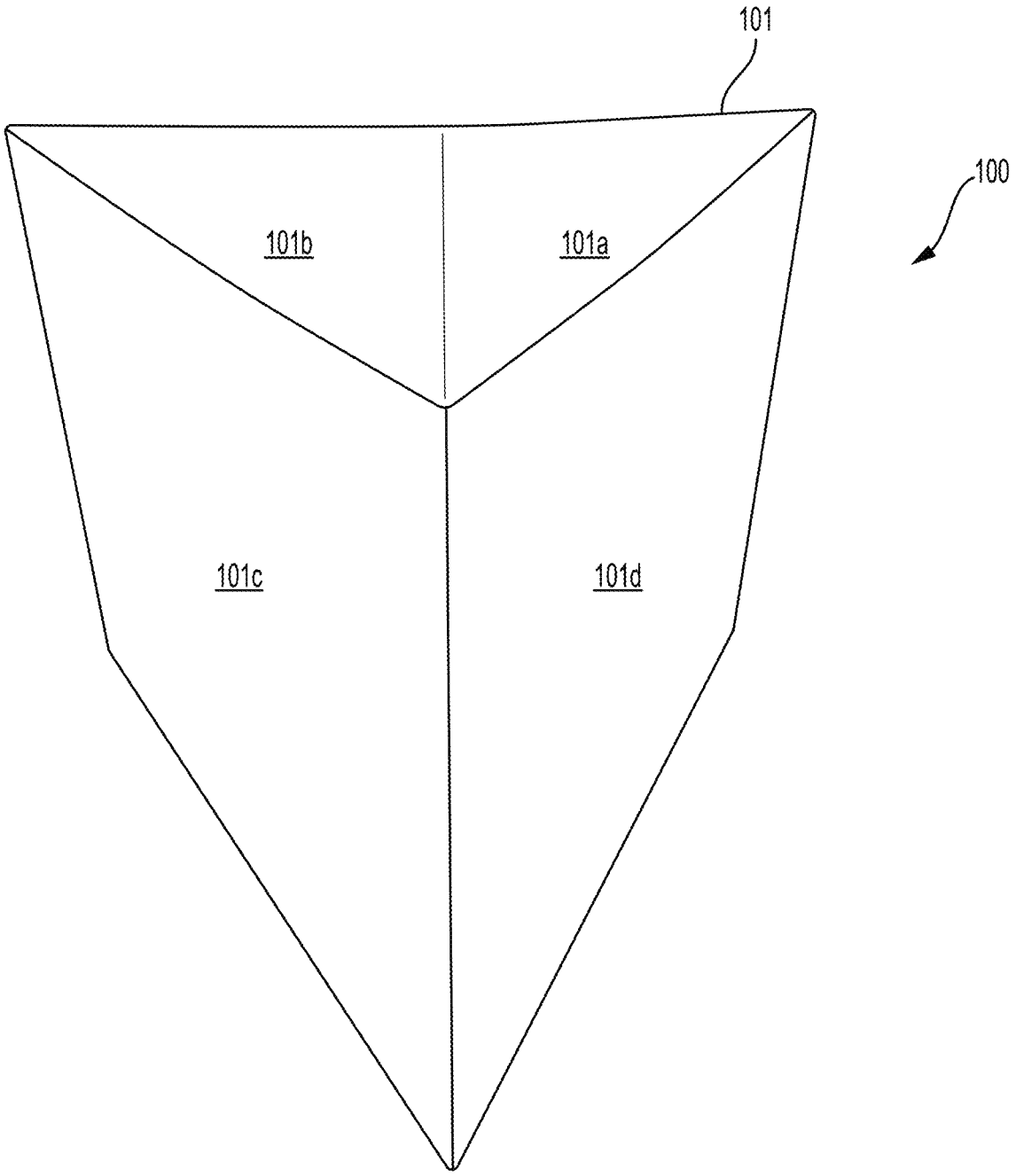
FIG. 1A is a top perspective view of an embodiment of a package in accordance with this disclosure, shown having a top in an open state.

Reference will now be made to the drawings wherein like reference numerals identify similar structural features or aspects of the subject disclosure. For purposes of explanation and illustration, and not limitation, an illustrative view of an embodiment of a package in accordance with the disclosure is shown in FIG. 1A and is designated generally by reference character 100. Other embodiments and/or aspects of this disclosure are shown in FIGS. 1B-4. Certain embodiments described herein can be used as easy-to-assemble packaging for any suitable purpose (e.g., retail, shipping, etc.).

The term "autobottom," as used in the present disclosure, means a bottom formed by panels that interact with each other to automatically form a bottom of a package when the package is constructed into its formed state.

In accordance with at least one aspect of this disclosure, referring to FIGS. 1A-1E, a package 100 (e.g., made from the blank 200 of FIG. 2) can include a three-sided body 101 formed of three or more body panels 101*a, b, c, d* and an autobottom 103 connected to the three-sided body 101 and formed of three or more bottom panels 103*a, b, c, d*, each extending from a respective body panel 101*a, b, c, d* of the plurality of the three or more body panels. The autobottom 103 can connect all of the three or more body panels 103*a, b, c, d* together in a triangular shape (e.g., as shown in FIG. 1A) when the three or more bottom panels 103*a, b, c, d* are interacting with each other (e.g., when the bottom panels are attached to each other directly or indirectly via glue or any other suitable connection, permanent or temporary).

Figure 1B:
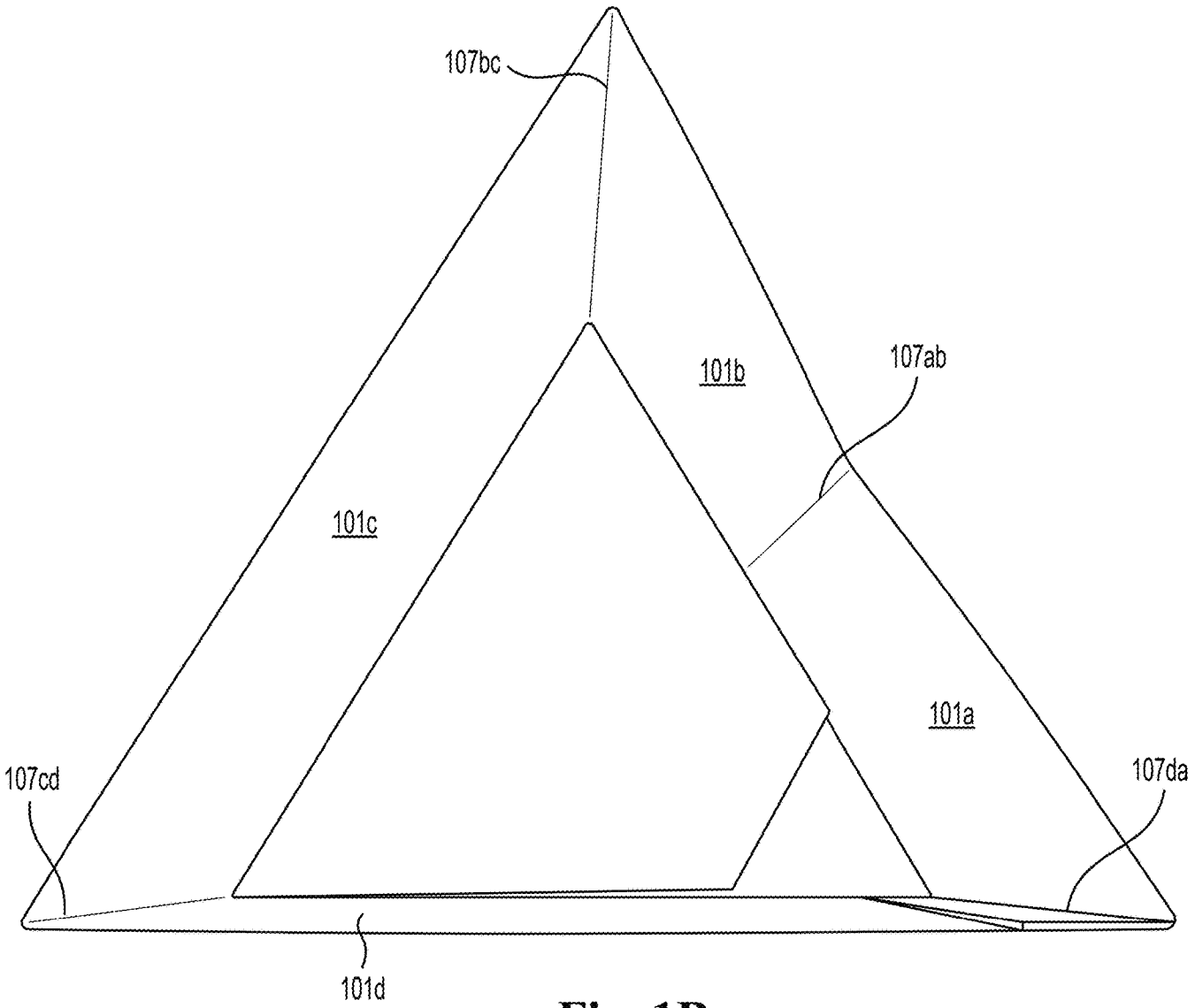
FIG. 1B is a top plan view of the embodiment of FIG. 1A, showing an assembled autobottom of the package.
Figure 1C:
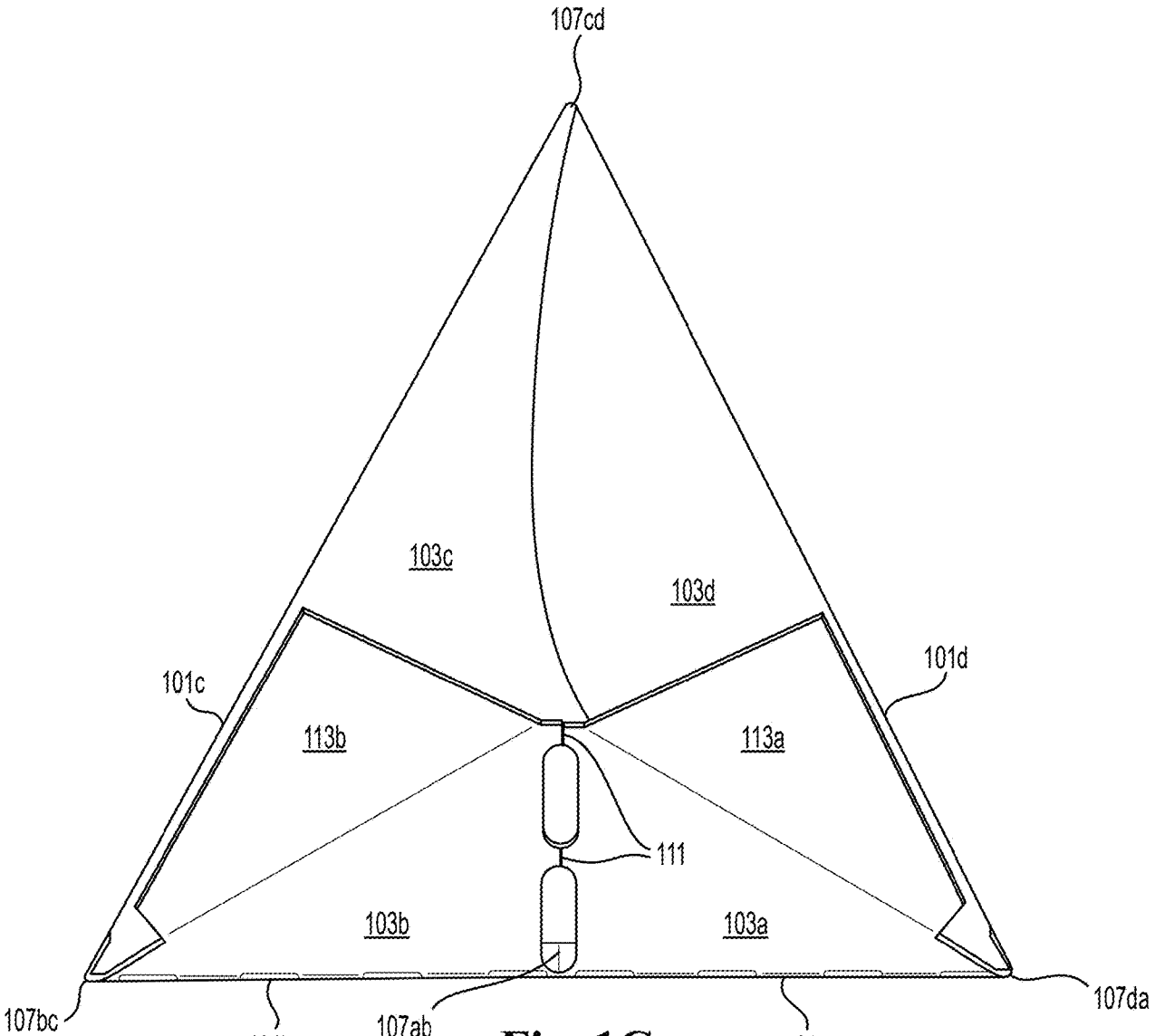
FIG. 1C is a bottom plan view of the embodiment of FIG. 1A, showing an assembled autobottom of the package.
Figure 1D:
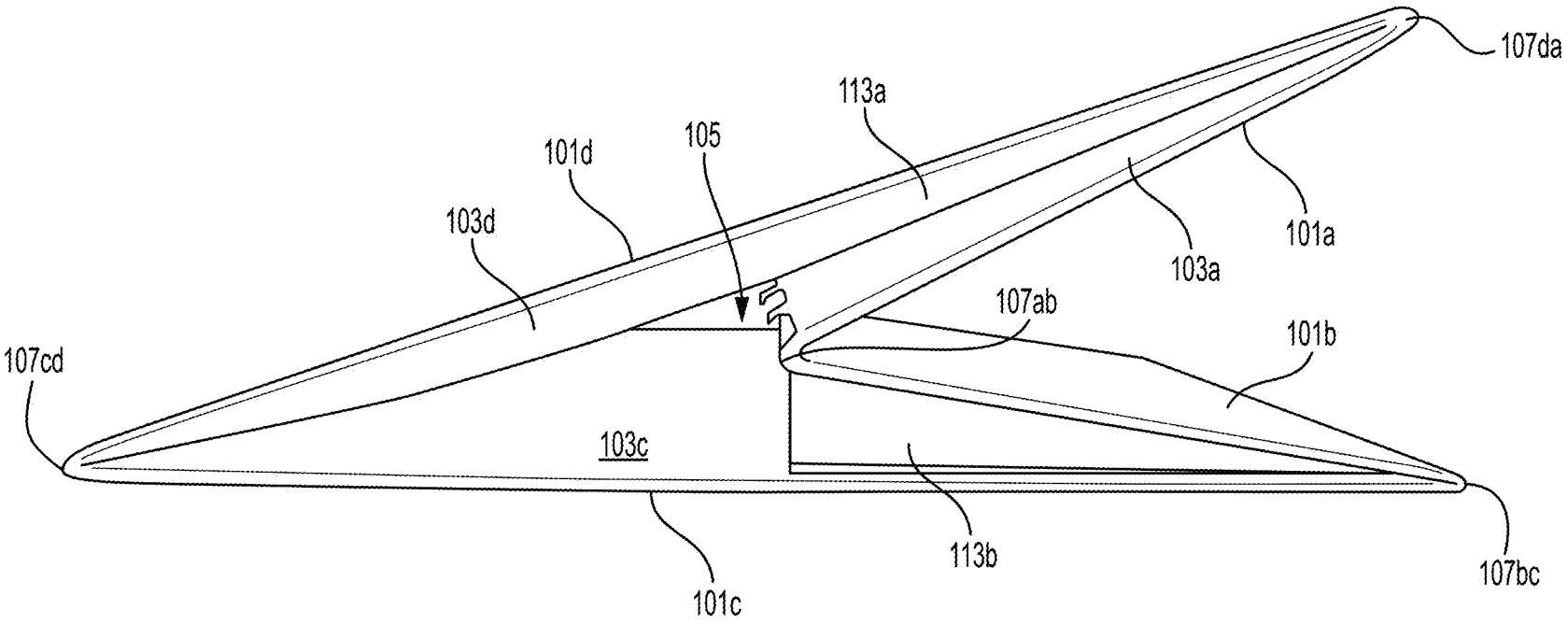
FIG. 1D is a bottom plan view of the embodiment of FIG. 1A, showing an assembled autobottom of the package in a folded state.

The autobottom 103 can be configured to fully enclose a bottom opening 105 (e.g., as shown in FIG. 1D) of the package 100. The autobottom 103 can fit entirely within the triangular shape such that no portion of the autobottom 103 extends laterally outside of the three or more body panels 101*a, b, c, d* when the three or more bottom panels 103*a, b, c, d* are interacting with each other (e.g., as shown in FIG. 1C).

The three or more body panels 101*a, b, c, d* can be sized to have a width such that the three-sided body forms an equilateral triangle for the triangular shape (e.g., as shown in FIGS. 1A-1C). In alternative arrangements, the three or more body panels 101*a, b, c, d* can be sized to have a width such that the three-sided body forms any triangular shape, e.g., isosceles, scalene, acute, right, and obtuse triangles. The three or more body panels 101*a, b, c, d* can include four body panels 101*a, b, c, d*, for example. The four body panels 101*a, b, c, d* can include a third body panel 101*c* and a fourth body panel 101*d* of the same size, and a first body panel 101*a* and a second body panel 101*b* together having a total size of the third body panel 101*c* or the fourth body panel 101*d*. In certain embodiments, the first body panel 101*a* and the second body panel 101*b* can each have a size that is half of the third body panel 101*c* or the fourth panel 101*d*. Any other suitable size for one or more of the panels 101*a, b, c, d* to form any triangular three-sided body 101 is contemplated herein.

Figure 1E:
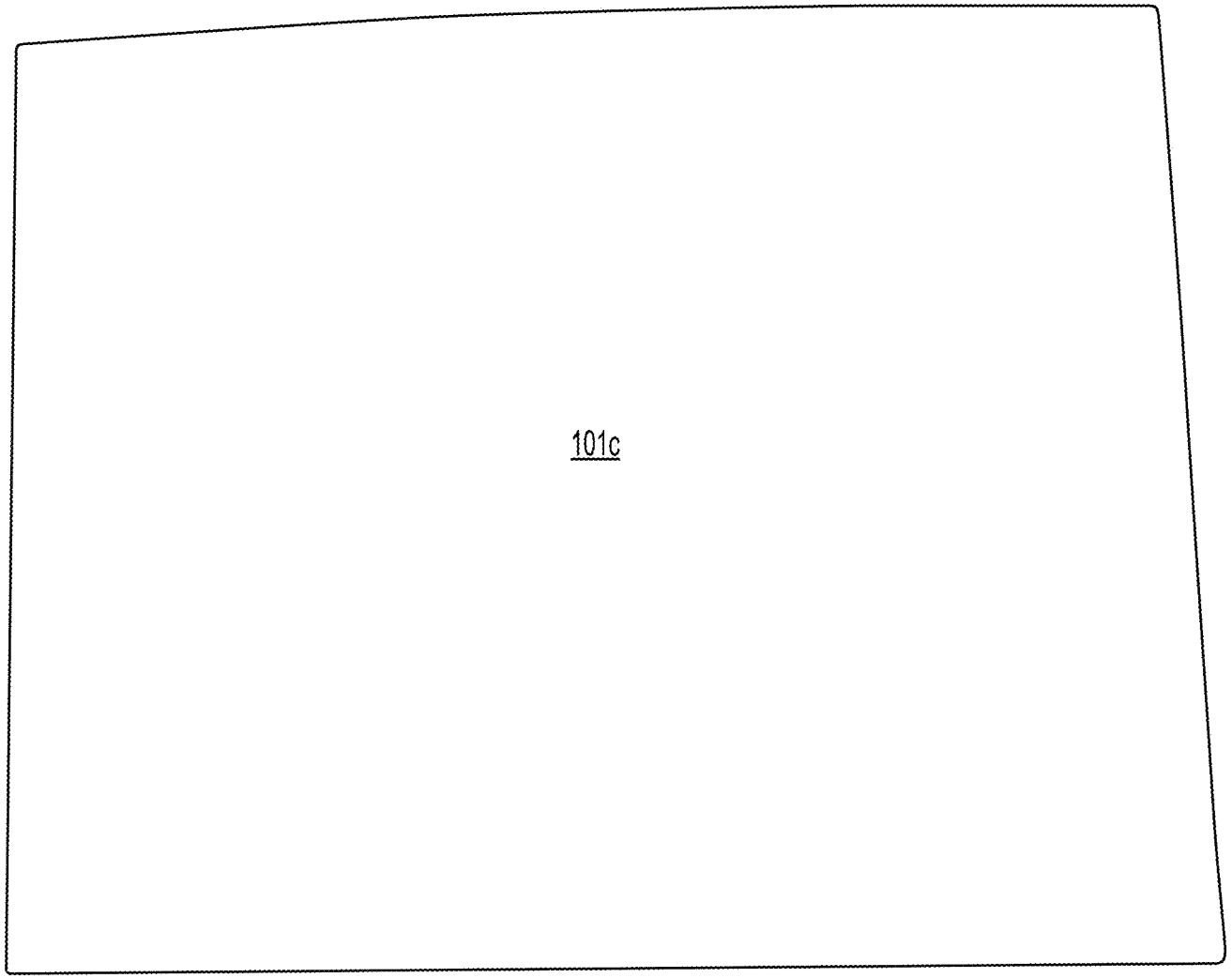
FIG. 1E is an elevation view of the embodiment of FIG. 1A, showing an assembled autobottom of the package in a folded state.

Each body panel 101*a, b, c, d* can be connected to each adjacent body panel 101*a, b, c, d* at a respective fold line 107*ab*, 107*bc*, 107*cd*. Any other suitable connections are contemplated herein. Fold line 107*ab* can allow the package 100 to fold from a formed state as shown in FIGS. 1A-1C) to a flattened state (e.g., as shown in FIGS. 1D and 1E).

Figure 2:
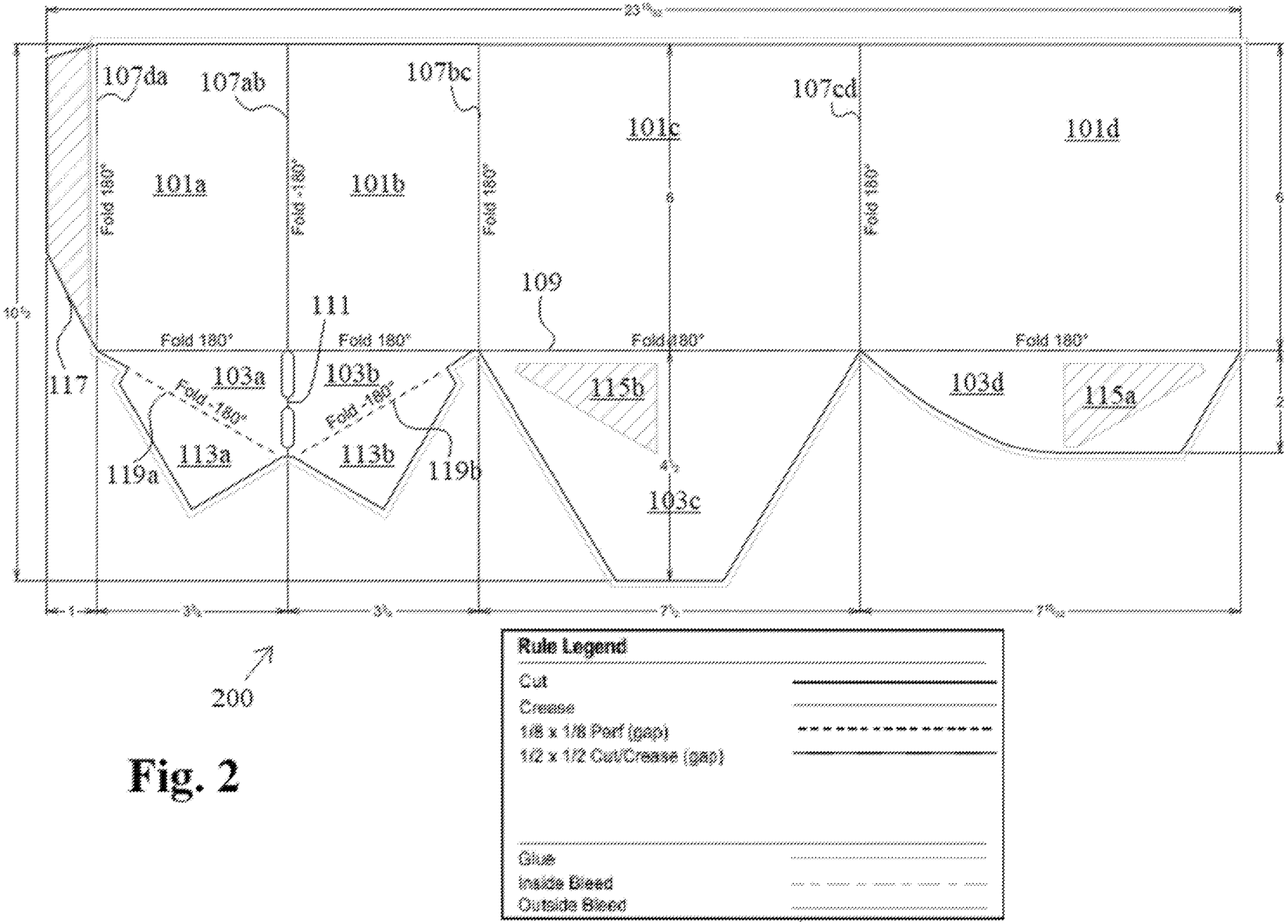
FIG. 2 is a plan view of an embodiment of a blank configured to form the embodiment of a package of FIGS. 1A-1E.

The three or more autobottom panels can include at least a first bottom panel 103*a*, a second bottom panel 103*b*, a third bottom panel 103*c*, and a fourth bottom panel 103*d*. Each bottom panel 103*a, b, c, d* can be foldably connected to a respective body panel (e.g., along a common fold line 109 as shown in FIG. 2, or any other suitable number of fold lines, whether common or independent).

The first bottom panel 103*a* and the second bottom panel 103*b* can be foldably or frangibly connected to each other or can be separated from each other. For example, in certain embodiments, the first and second bottom panels 103*a*, 103*b* can have a line 111 defined between the first and second bottom panels 103*a*, 103*b*. The line 111 can be a joint that breaks apart while folding that is made to stay together while gluing bottom panels together, e.g., for ease of assembly. In certain embodiments, line 111 can be a cut line. As shown, holes 113 can be used to reduce the amount of line 111 that has to break, e.g., where line 111 is a breakable line to form a frangible connection. As appreciated by those having ordinary skill in the art in view of this disclosure, when transformed to the folded state, bottom panels 103*a* and 103*b* can be configured to separate and fold up (e.g., as shown in FIG. 1D).

The package 100 can include a first attachment tab 113*a* foldably connected (e.g., at a fold line 119*a* as shown) to the first bottom panel 103*a*. The package 100 can include a second attachment tab 113*b* foldably connected (e.g., at a fold line 119*b* as shown) to the second bottom panel 103*b*. Referring additionally to a package 300 and a blank 400 therefor shown in FIGS. 3 and 4, in certain embodiments, a third attachment tab 313*d* can be foldably connected (e.g., at a fold line 319*d* as shown) to the fourth bottom panel 303*d*.

Figure 3:
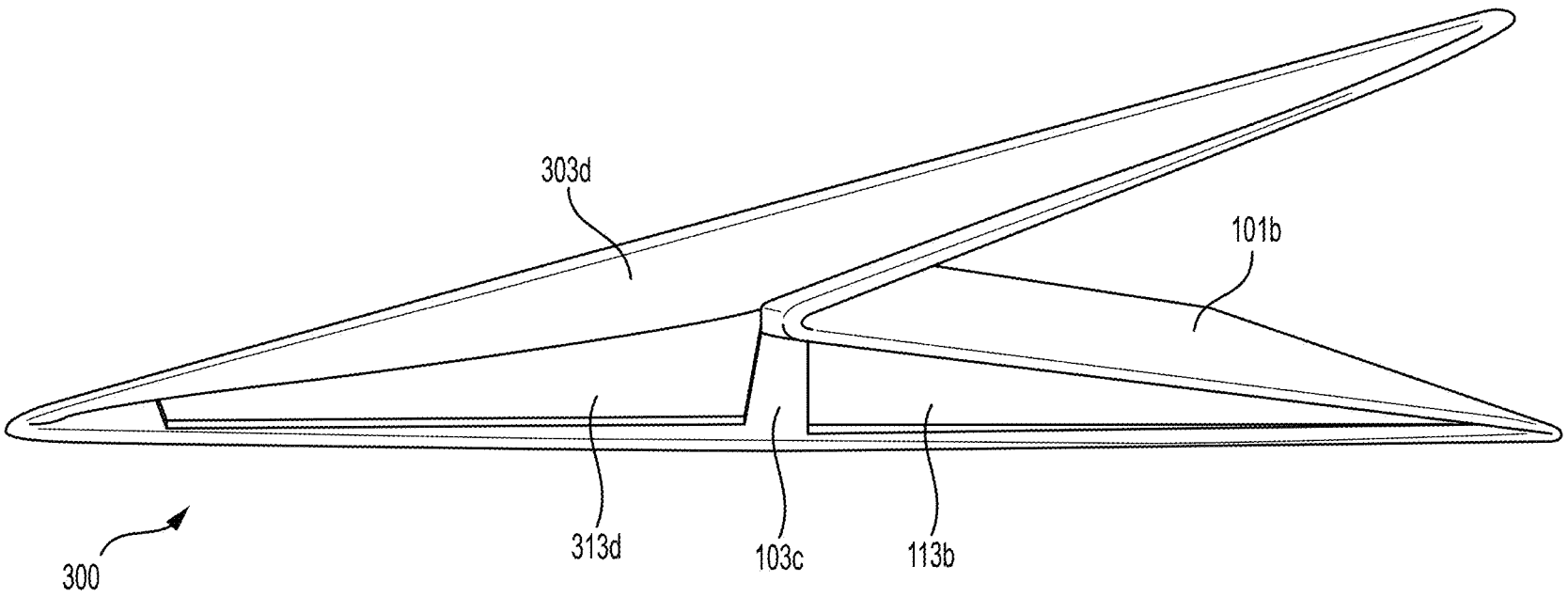
FIG. 3 is a bottom plan view of an embodiment of a package in accordance with this disclosure, showing an assembled autobottom of the package in a folded state.
Figure 4:
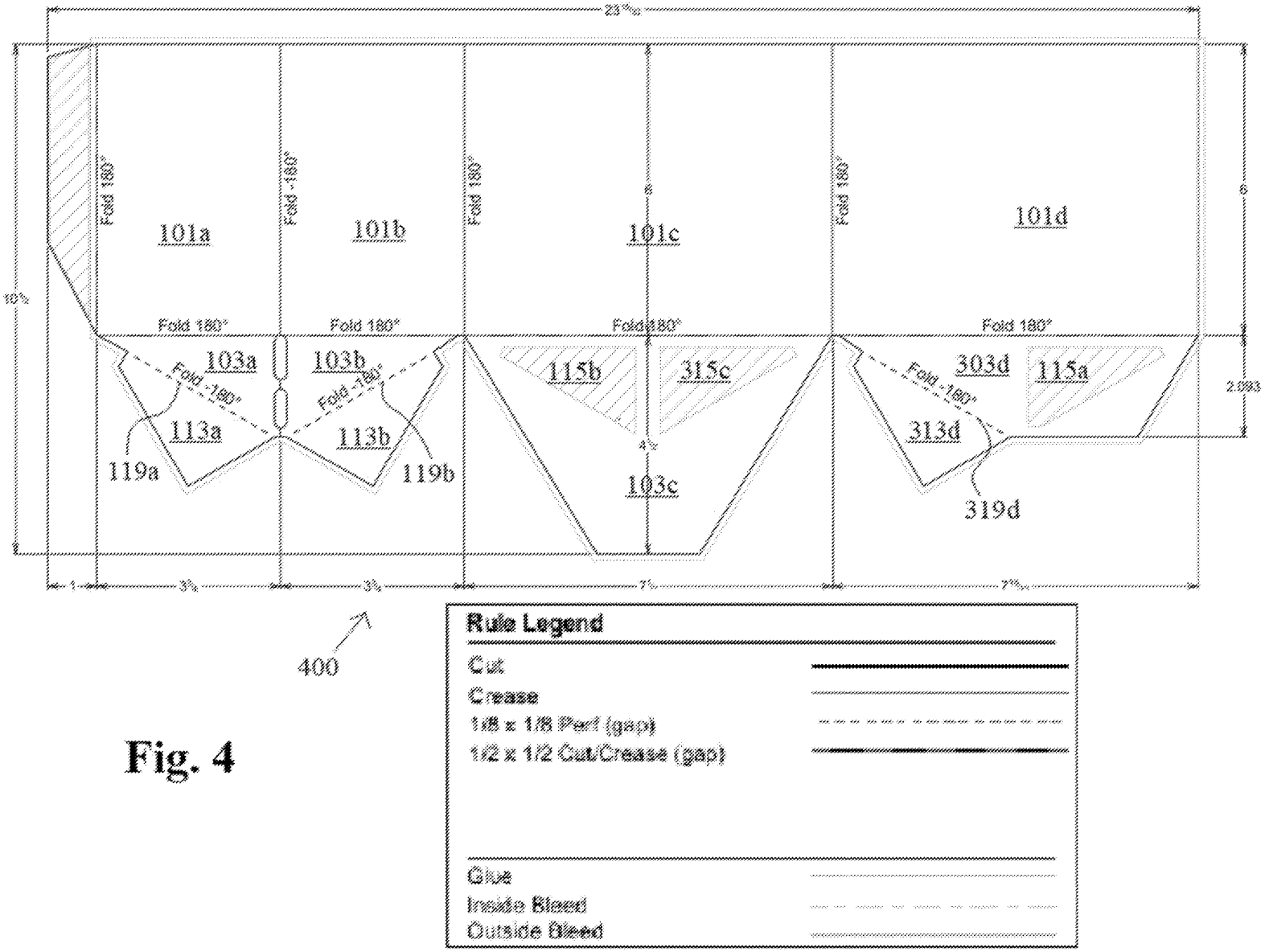
FIG. 4 is a plan view of an embodiment of a blank configured to form the embodiment of a package of FIG. 3.

Referring to FIG. 1C, the first attachment tab 113*a* can be attached to an underside of the fourth bottom panel 103*d* and the second attachment tab 113*b* can be attached to an underside of the third bottom panel 103*c*. In certain embodiments having the third attachment tab 313*d*, e.g., as shown in FIG. 3, the third attachment tab 313*d* can be attached to an underside of the third bottom panel 103*c*. Each attachment tab 113*a, b, d* can be attached in any suitable manner (e.g., adhered with glue, tape, or otherwise attached). For example, in certain embodiments, as shown in FIG. 2, the third bottom panel 103*c* and the fourth bottom panel 103*d* can include at least one glue patch 115*a*, 115*b* disposed thereon (e.g., complimentary in shape to the second attachment tab 113*b* and the first attachment tab 113*a*, respectively). As shown in FIGS. 3 and 4, the third bottom panel 103*c* can include an additional glue patch 315*c* for adhering the third attachment tab 113*d* to the third bottom panel 103*c*.

The package 100 can be configured to fold into a flattened position (e.g., as shown in FIGS. 1D and FIG. 3) by allowing the first and second body panels 101*a, b* to be folded inwardly (and/or outwardly) while allowing the bottom panels 103*a, b, c, d* to be folded upwardly (and/or downwardly), for example. Each attachment tab 113*a, b, c* can be configured to fold relative to a respective bottom panel 101*a, b* (and 303*d*) to allow the bottom panels 101*a, b, c, d* (and/or 303*d*) to be folded upwardly (and/or downwardly), for example.

As shown in FIGS. 1A-2, an attachment panel 117 can be attached to the first body panel 101*a* (e.g., at fold line 107*da*). An attachment panel 117 can be attached to either or both of a first body panel (e.g., 101*a*) or a last body panel (e.g., 101*d*). Any suitable number of attachment panels 117 are contemplated herein. The attachment panel 117 can include glue disposed thereon, e.g., as shown in FIGS. 2 and 4, or any other suitable attachment type for connecting the first and last body panels together to form the triangular body.

Embodiments of a package 100, 300 can include a top. The top can be any suitable top type (folding closure, separate top, etc.), and may include a single top panel or multiple top panels.

In accordance with at least one aspect of this disclosure, a blank, e.g., blanks 200, 400 can be configured to form any embodiment of a package, e.g., 100, 300, as disclosed herein (e.g., as described above). In accordance with at least one aspect of this disclosure, a blank for a package can include three or more body panels 101*a, b, c, d* connected by a respective body fold line 101*ab*, 101*bc*, 101*cd* between each body panel 101*a, b, c, d* and configured to form a triangular shape. The blank can include a plurality of bottom panels 103*a, b, c, d*, with each bottom panel of the plurality of bottom panels 103*a, b, c, d* foldably connected (e.g., at a common fold line 109, or any other suitable number of fold lines, whether common or independent) to a respective body panel of the three or more body panels 101*a, b, c, d*. The plurality of bottom panels 103*a, b, c, d* can be configured to form an autobottom 103 that at least partially forms a bottom of the package 100, 300, for example. The autobottom 103 can connect all of the three or more body panels 101*a, b, c, d* together in a triangular shape when the three or more bottom panels 103*a, b, c, d* are interacting (e.g., mechanically connected, glued, or otherwise interacting) with each other in an opened state (e.g., as shown in FIG. 1A).

The autobottom 103 can be configured to fully enclose a bottom opening of the package 100, 300. The three or more body panels 101*a, b, c, d* can be the dimensioned such that the three-sided body forms an equilateral triangle for the triangular shape. Any other suitable type of triangular shape is contemplated herein. In certain embodiments, the autobottom 103 can be configured to automatically form the bottom when the body panels 101*a, b, c, d* are moved to be in the triangular shape (e.g., after an initial assembly of the blank 200, 400).

The triangular shape can be a regular triangle, for example, or any other suitable triangle. In certain embodiments, the triangular shape can be an irregular triangle, an equilateral triangle, a right triangle, an obtuse triangle, an acute triangle, or an isosceles triangle (e.g., having sides with different widths).

The first bottom panel 103*a* can have a substantially triangular shape and can have a first attachment tab 113*a* foldably connected thereto. The second bottom panel 103*b* can have a substantially triangular shape and can have a second attachment tab 113*b* foldably connected thereto.

The third bottom panel 103*c* can have a substantially trapezoidal shape or substantially triangular shape and/or can include a glue patch 115*b*. In certain implementations the substantially trapezoidal shape is a substantially symmetric trapezoidal shape. The fourth bottom panel 103*d* can have a substantially trapezoidal shape (e.g., non-isosceles) or similar polygonal shape, with or without one or more curved or rounded edges, and/or can include a glue patch 115*a*. Any other suitable shapes and/or sizes are contemplated herein. While certain glue patches are shown in the figures, it is contemplated that the glue patches shown can be moved to any other suitable location (e.g., on the attachment tabs instead of the bottom panels). Glue is shown as hatching in FIGS. 2 and 4.

The blank 200 can further include at least one attachment panel 117 foldably connected to the first body panel 101*a*. The attachment panel can include glue or otherwise be configured to attach to the fourth body panel 101*d* or other last body panel. The fourth body panel 101*d* or other last body panel can be configured to be attached to the attachment panel 117, e.g., via glue on the attachment panel. In certain arrangements, attachment panel 117 can be attached to either or both of a first body panel (e.g., 101*a*) or a last body panel (e.g., 101*d*). Any suitable number of attachment panels 117 are contemplated herein.

The blank 200, 400 can include any other suitable panels for any other suitable function (e.g., locking portions, a top, locking tabs, etc.). The blanks 200, 400 can be assembled as appreciated by those having ordinary skill in the art in view of this disclosure.

Embodiments of a package, e.g., as shown and/or described above, can be formed from any suitable embodiment of a blank (e.g., as described above). A blank can be made from any suitable material (e.g., paper, paperboard, plasticboard, corrugated board, etc.).

While certain panel shapes are shown in the figures, any other suitable panel shapes to form a triangular autobottom are contemplated herein. In view of this disclosure, one having ordinary skill in the art appreciates how to make blanks for, and assemble packages having, a triangular shape with an autobottom. Any suitable adhesive can be applied to any suitable panel disclosed herein for any suitable purpose. Any suitable foldable line types are contemplated herein (e.g., perforated, creased, cut/creased, etc.). While the figures include a legend indicating the line types of the embodiments of the figures, any other suitable line types for the lines shown in the drawings are contemplated herein. Embodiments provide a package that is easy to set up and maintain the shape.

Embodiments include a unique, fully functional triangular autobottom. Embodiments can be pre-glued and sent flat to the customer, for example. Embodiments can be easy to open from a flat state to be used as a container after opening.

While embodiments have been described and shown above, any suitable panels and/or other design for a blank to form a triangular package is contemplated herein. Any suitable material for use (e.g., paper, cardboard, plastic board, etc.) is contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A package, comprising:

a three-sided body formed of three or more body panels; and an autobottom connected to the three-sided body and formed of three or more bottom panels extending from a respective body panel of the plurality of the three or more body panels, wherein the autobottom connects all of the three or more body panels together in a triangular shape when the three or more bottom panels are interacting with each other wherein each of the three or more bottom panels comprising at least a first bottom panel, a second bottom panel and a third bottom panel, each foldably connected to respective body panel among the three or more body panels, wherein the first bottom panel and the second bottom panel being foldably and breakably connected to each other.

2. The package of claim 1, wherein the autobottom is configured to fully enclose a bottom opening of the package.

3. The package of claim 2, wherein the autobottom fits entirely within the triangular shape such that no portion of the autobottom extends laterally outside of the three or more body panels when the three or more bottom panels are interacting with each other.

4. The package of claim 1, wherein the three or more body panels are dimensioned such that the three-sided body forms an equilateral triangle for the triangular shape.

5. The package of claim 1, wherein the three or more body panels include four body panels.

6. The package of claim 5, wherein the four body panels include a third body panel and a fourth body panel of the same size, and a first body panel and a second body panel together having a total size of the third body panel or the fourth body panel.

7. The package of claim 6, wherein the first body panel and the second body panel each have a size that is half of the third body panel or the fourth panel.

8. The package of claim 7, wherein each body panel is connected to each adjacent body panel at a respective fold line.

9. The package of claim 5, wherein the three or more autobottom panels comprises at least the first bottom panel, the second bottom panel, the third bottom panel, and a fourth bottom panel, each foldably connected to a respective body panel.

10. The package of claim 9, further comprising a first attachment tab foldably connected to the first bottom panel, and a second attachment tab foldably connected to the second bottom panel.

11. The package of claim 1, further comprising a third attachment tab foldably connected to the fourth bottom panel.

12. The package of claim 11, wherein the first attachment tab is attached to an underside of the fourth bottom panel and the second attachment tab is attached to an underside of the third bottom panel.

13. The package of claim 12, wherein the package is configured to fold into a flattened position by allowing the first and second body panels to be folded inwardly while allowing the bottom panels to be folded upwardly, wherein each attachment tab is configured to fold relative to a respective bottom panel to allow the bottom panels to be folded upwardly.

14. The package of claim 11, wherein the third attachment tab is attached to an underside of the third bottom panel.

15. A blank configured to form a package of claim 1.

16. A blank for a package, comprising:

three or more body panels connected by a respective body fold line between each body panel and configured to form a triangular shape; and a plurality of bottom panels, a respective bottom panel of the plurality of bottom panels foldably connected to a respective body panel of the three or more body panels, wherein the plurality of bottom panels are configured to form an autobottom that at least partially forms a bottom of the package, wherein the autobottom connects all of the three or more body panels together in a triangular shape when the three or more bottom panels are interacting with each other in an opened state, wherein each of the three or more bottom panels comprising at least a first bottom panel, a second bottom panel and a third bottom panel, each foldably connected to respective body panel among the three or more body panels, wherein the first bottom panel and the second bottom panel being foldably and breakably connected to each other.

17. The blank of claim 16, wherein the autobottom is configured to fully enclose a bottom opening of the package.

18. The blank of claim 16, wherein the three or more body panels are the dimensioned such that the three-sided body forms an equilateral triangle for the triangular shape.

19. The blank of claim 16, wherein the triangular shape is a regular triangle, wherein the first bottom panel has a substantially triangular shape and has a first attachment tab foldably connected thereto, wherein the second bottom panel has a substantially triangular shape and has a second attachment tab foldably connected thereto, wherein the third bottom panel has a substantially trapezoidal shape or substantially triangular shape, wherein the fourth bottom panel has a substantially trapezoidal shape.

* * * * *